US008708054B2

(12) United States Patent
Dailey, Jr.

(10) Patent No.: US 8,708,054 B2
(45) Date of Patent: Apr. 29, 2014

(54) DUAL PATH SUBSEA CONTROL SYSTEM

(75) Inventor: Terrell Eugene Dailey, Jr., Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 455 days.

(21) Appl. No.: 12/964,350

(22) Filed: Dec. 9, 2010

(65) Prior Publication Data

US 2011/0137471 A1 Jun. 9, 2011

Related U.S. Application Data

(60) Provisional application No. 61/267,852, filed on Dec. 9, 2009.

(51) Int. Cl.
*E21B 34/04* (2006.01)

(52) U.S. Cl.
USPC ..... 166/368; 166/344; 166/352; 166/250.01; 166/373; 700/82

(58) Field of Classification Search
USPC ..... 166/336, 344, 346, 351, 352, 363, 364, 166/368, 250.01, 373–375, 66.6; 340/853.1, 854.9; 700/82; 702/6
See application file for complete search history.

(56) References Cited

U.S. PATENT DOCUMENTS 4,174,000 A * 11/1979 Milberger ..... 166/363
4,636,934 A * 1/1987 Schwendemann et al. ..... 700/3
4,880,060 A * 11/1989 Schwendemann et al. ... 166/336
6,125,938 A * 10/2000 Garcia-Soule et al. ..... 166/344
6,202,753 B1 3/2001 Baugh
6,343,654 B1 * 2/2002 Brammer ..... 166/338
6,595,487 B2 * 7/2003 Johansen et al. ..... 251/129.04
7,539,548 B2 * 5/2009 Dhawan ..... 700/19
8,376,051 B2 * 2/2013 McGrath et al. ..... 166/368
2005/0155658 A1 7/2005 White
2005/0217845 A1 * 10/2005 McGuire ..... 166/100
2005/0232145 A1 * 10/2005 Tanju ..... 370/217
2007/0240882 A1 * 10/2007 Leonardi et al. ..... 166/364
2008/0110633 A1 * 5/2008 Trewhella ..... 166/336
2008/0202761 A1 * 8/2008 Trewhella ..... 166/351
2009/0038804 A1 * 2/2009 Going, III ..... 166/335
2009/0229830 A1 * 9/2009 Kerr ..... 166/336
2009/0260829 A1 * 10/2009 Mathis ..... 166/336

OTHER PUBLICATIONS

International Search Report dated Jun. 29, 2011.

* cited by examiner

*Primary Examiner* — Matthew Buck
(74) *Attorney, Agent, or Firm* — Jeffrey R. Peterson; Brandon S. Clark

(57) ABSTRACT

A technique enables protection of subsea wells. The technique employs a subsea test tree and associated control system to ensure control over the well in a variety of situations. The subsea test tree may be formed with an upper portion releasably coupled to a lower portion. The upper portion employs at least one upper shut-off valve, and the lower portion employs at least one lower shut-off valve to protect against unwanted release of fluids from either above or below the subsea test tree. The subsea test tree also is coupled with the control system in a manner which allows control to be exercised over the at least one upper shut-often valve and the at least one lower shut-off valve.

20 Claims, 7 Drawing Sheets

DUAL PATH SUBSEA CONTROL SYSTEM

CROSS-REFERENCE TO RELATED APPLICATION

The present document is based on and claims priority to U.S. Provisional Application Ser. No. 61/267,852, filed Dec. 9, 2009.

BACKGROUND

A variety of subsea control systems are employed for use in controlling subsea wells during, for example, emergency shutdowns. Depending on the environment and location of a given subsea well, various standards or protocols govern operation of the well. In some applications, gas and oil wells are required to meet specific safety integrity levels. Instrumented systems have been integrated into subsea wells to ensure against unwanted discharge of fluids into the surrounding subsea environment.

SUMMARY

In general, the present application provides a technique for enabling protection of subsea wells. The technique employs a subsea test tree and associated control system to ensure control over the well in a variety of situations, e.g. a dual path control design. The subsea test tree may be formed with an upper portion releasably coupled to a lower portion. The upper portion may employ at least one upper shut-off valve, and the lower portion may employ at least one lower shut-off valve to protect against unwanted release of fluids from either above or below the subsea test tree. The subsea test tree also is coupled with the control system in a manner which allows control to be exercised over the at least one upper and at least one lower shut-off valves.

BRIEF DESCRIPTION OF THE DRAWINGS

Certain embodiments will hereafter be described with reference to the accompanying drawings, wherein like reference numerals denote like elements, and.

DETAILED DESCRIPTION

In the following description, numerous details are set forth to provide an understanding of the present embodiments. However, it will be understood by those of ordinary skill in the art that embodiments may be practiced without these details and that numerous variations or modifications from the described embodiments may be possible.

The present application generally relates to a subsea control system comprising a subsea test tree, such as a subsea test tree located within a riser, and an associated dual path control system. According to one embodiment, the subsea control system is a subsea wellhead control system comprising a subsea installation with an independently controlled subsea test tree. The subsea test tree comprises an upper portion separable from a lower portion and a plurality of shut-off valves. At least one shut-off valve is located in each of the upper portion and the lower portion.

The present technique and components, as described in greater detail below, may be used in cooperation with existing components and control systems. In one specific embodiment, for example, the present technique may be employed with the SenTURIAN™ Deep Water Control System manufactured by Schlumberger™ Corporation. The system may be employed as a safety instrumented system as defined by one or more applicable standards, such as IEC61508. In this example, the IEC61508 standard is selected and covers safety-related systems when such systems incorporate electrical, electronic, or programmable electronic (E/E/PE) devices. Such devices may include a variety of devices from electrical relays and switches through programmable logic controllers (PLCs). The standard is designed to cover possible hazards created when failures of the safety functions performed by E/E/PE safety-related systems occur. The international standard IEC61508, although generic, is an example of a standard which is becoming more widely accepted as a basis for the specification, design and operation of programmable electronic systems in the petroleum production industry.

Various control systems, e.g. deep water control systems, are designed according to predetermined safety integrity levels (SILs). In the description herein, SIL level determination is not addressed, but instead SIL levels are discussed as outlined by the Norwegian Petroleum Directorate for the safety functions carried out by the system, e.g. SIL2. By definition, SIL2 ensures that the safe failure fraction is between 90% and 99% assuming a hardware fault tolerance of zero. SIL2 also implies that the probability of failure on demand for dangerous undetected failures is between 0.01 and 0.001, thus resulting in a risk reduction factor of between 100 and 1000.

Figure 1:
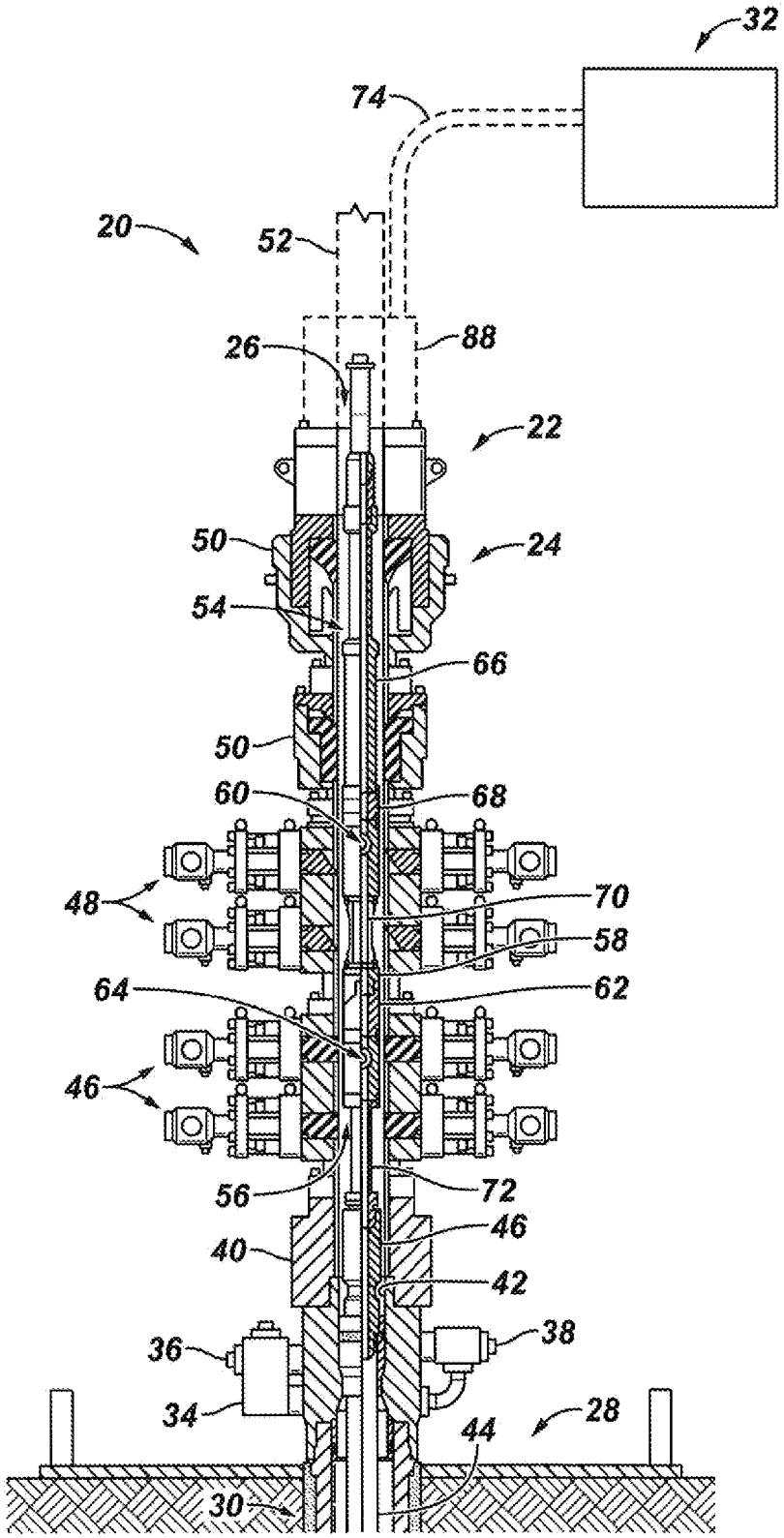
FIG. 1 is an illustration of one example of a subsea installation and an associated control system, according to an embodiment.

Referring generally to FIG. 1, a well system 20 is illustrated. In the example illustrated, well system 20 is a subsea control system comprising a subsea installation 22 which includes a production control system 24 cooperating with a subsea test tree 26. The subsea installation 22 is positioned at a subsea location 28 generally over a well 30 such as an oil and/or gas production well. Additionally, a control system 32 is employed to control operation of the production control system 24 and subsea test tree 26. The control system 32 may comprise an integrated system or independent systems for controlling the various components of the production control system and the subsea test tree.

Although the production control system 24 and subsea test tree 26 may comprise a variety of components depending on the specific application and well environment in which a production operation is to be conducted, specific examples are discussed to facilitate an understanding of the present system and technique. In one example, production control system 24 comprises a horizontal tree section 34 having, for example, a production line 36 and an annulus line 38. A blowout preventer 40, e.g. a blowout preventer stack, may be positioned in cooperation with the horizontal tree section 34 to protect against blowouts. These components also comprise an internal passageway 42 to accommodate passage of tubing string components 44 and related components, such as a tubing hanger/running tool 46.

The production control system 24 also may comprise a variety of additional components incorporated into or positioned above blowout preventer 40. For example, at least one pipe ram 46 may be mounted in subsea installation 22 at a suitable location. Two pipe rams 46 can be employed. The system also may comprise at least one shear ram 48, such as the two shear rams illustrated. Additionally, one or more, e.g. two, annular rams 50 may be employed in the system. The various production control systems 24 accommodate a riser 52 designed to receive subsea test tree 26.

In the embodiment illustrated, the subsea test tree 26 comprises an upper portion 54 releasably coupled with a lower portion 56 via a connector 58, such as a latch connector. The upper portion 54 and the lower portion 56 each contain at least one shut-off valve which may be selectively actuated to block flow of production fluid through the subsea installation 22. The various components of subsea installation 22 are designed to allow an emergency shutdown. For example, subsea test tree 26 enables provision of a safety system installed within riser 52 during completion operations to facilitate safe, temporary closure of the subsea well 30. The control system 32 provides hydraulic power to the subsea test tree 26 to enable control over the shut-off valves. Control over the subsea test tree 26 may be independent of the safety functions of the production control system 24, such as actuation of blowout preventer 40.

The shut-off valves in subsea test tree 26 may range in number and design. In one embodiment, the upper portion 54 comprises a retainer valve 60, as further illustrated in FIG. 2. The lower portion 56 may include a pair of valves in the form of a flapper valve 62 and a ball valve 64. As desired for a given application, other components may be incorporated into subsea test tree 26. For example, the upper portion 54 may comprise additional components in the form of a space out sub 66, a bleed off valve 68, and a shear sub 70. Similarly, the lower portion 56 may comprise additional components, such as a ported joint 72 extending down to tubing hanger 46.

The shut-off valves may be controlled electrically, hydraulically, or by other suitable techniques. In the embodiment illustrated, however, valves 60, 62, 64 are controlled hydraulically via hydraulic lines 74. For example, the position of the valves 60, 62, 64 may be controlled via a combination of opened or closed directional control valves 76 located in, for example, a subsea control module 78. The directional control valve 76 control whether hydraulic pressure is present or vented on its assigned output port in the subsea test tree. The directional control valves 76 within subsea control module 78 may be controlled via solenoid valves or other actuators which may be energized via electrical signals sent from the surface. Accordingly, the overall control system 32 for controlling subsea test tree 26 may have a variety of topside and subsea components which work in cooperation.

During a specific valve operation, an operations engineer may issue a command via a human machine interface 80 of a master control station 82, such as a computer-based master control station. In some applications, the master control station 82 comprises or works in cooperation with one or more programmable logic controllers (PLC). Electric current is sent down through an umbilical 84 to the solenoid valves and subsea control module 78 to actuate directional control valves 76. The umbilical 84 also may comprise one or more hydraulic control lines extending down to the subsea control module from a hydraulic power unit 86. In the embodiment illustrated in FIGS. 1 and 2, the hydraulic lines 74 also are routed to an accumulator 88, such as a subsea accumulator module.

When a desired directional control valve 76 is opened, hydraulic pressure supplied by hydraulic power unit 86 is passed through its assigned output port to the subsea test tree 26. Conversely, when a directional control valve 76 is closed, any hydraulic pressure present at its output port is vented. Hydraulic power is transferred from the subsea accumulator module 88 to a particular valve 60, 62, 64 located in the subsea test tree 26. The designated valve transitions and fulfills the intended safety instrumented function for a given situation.

An emergency shutdown sequence may be achieved through a series of commands sent to one or more of the valves 60, 62 and 64. The emergency shutdown sequence may be designed to bring the overall system to a safe state upon a given command. Depending on the specific application, the emergency shutdown sequence also may control transition of additional valves, e.g. a topside production control valve, to a desired safety state.

If a complete loss of communication between the topside and subsea equipment occurs, i.e. loss or severing of the umbilical 84, the directional control valves 76 are designed to return to a natural or default state via, for example, spring actuation. This action automatically brings the well to a fail safe position with the topside riser and the well sealed and isolated. If the topside equipment is unable to bring the well into a safe state, then the operator can institute a block-and-bleed on the hydraulic power unit 86 to cause the subsea test tree to transition into its failsafe configuration. Additionally, visual and/or audible alerts may be used to alert an operator to a variety of fault or potential fault situations.

Figure 2:
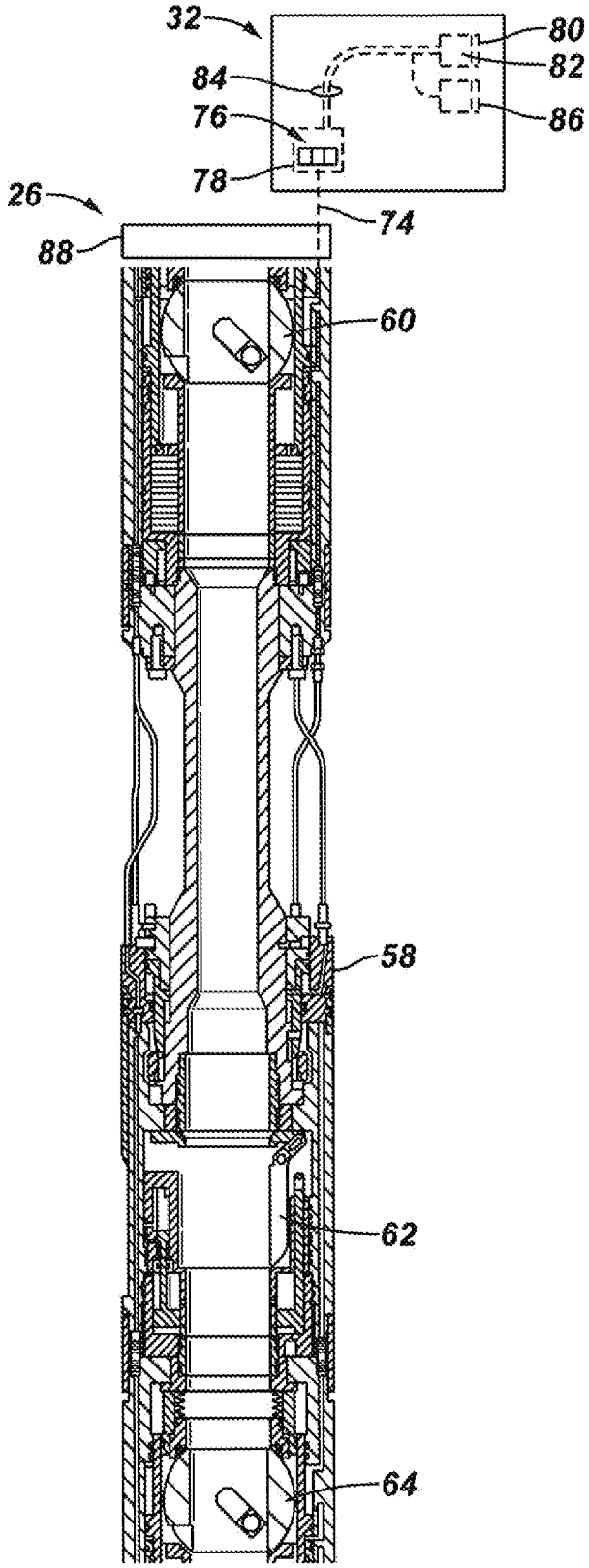
FIG. 2 is an illustration of a portion of one example of a subsea test tree that can be used at the subsea installation, according to an embodiment.

In the specific example illustrated in FIG. 2, the subsea test tree 26 has four basic functions utilizing retainer valve 60, connector 58, flapper valve 62, and ball valve 64. The retainer valve 60 functions to contain riser fluids in riser 52 after upper portion 54 is disconnected from lower portion 56. The connector 58, e.g. latch mechanism, enables the riser 52 and upper portion 54 to be disconnected from the remaining subsea installation 22. The flapper valve 62 provides a second or supplemental barrier used to isolate and contain the subsea well. Similarly, the ball valve 64 is used to isolate and contain the subsea well as a first barrier against release of production fluid.

The subsea test tree 26 may be used in a variety of operational modes. For example, the subsea test tree 26 may be transitioned to a "normal mode". In this mode, a standard emergency shutdown sequence may be used in which a ball valve close function is performed to close ball valve 64. By way of example, the ball valve 64 may be closed by supplying hydraulic fluid at a desired pressure, e.g. 5 kpsi. Another mode is employed as the subsea test tree system is run in hole or pulled out of hole (RIH/POOH mode). In this mode, the valve functions are disabled to prevent a spurious unlatch at connector 58 while the assembly is suspended in riser 52. In another example, the system is placed in a "coil tubing" mode when coil tubing is present in riser 52 while a disconnect is to be initiated. In this mode, the ball valve is actuated under a higher pressure, e.g. 10 kpsi, to enable severing of the tubing via, for example, shear rams 48.

The control system 32 also may be designed to operate in a diagnostic mode. The diagnostic mode is useful in determining the integrity of the signal path as well as the basic functionality of the subsea control module, including the solenoid valves and directional control valves. In this mode, a selected current, e.g. a 30 mA current, is delivered down each of the electric lines, e.g. seven lines, within umbilical 84. Then, by verifying the voltage required to drive this current, the impedance of the system can be inferred. This current is insufficient to trigger a solenoid into actuation, but the current may be used to verify various operational parameters. Examples of verifying operational parameters include: verifying delivery of power to the system from an uninterruptible power supply; verifying the solenoid driver power supply is functional; verifying performance of a programmable logic controller; verifying that all connectors are intact; and verifying solenoids have not failed in an open or shorted manner. The diagnostic testing can be performed on command from a SCADA, or as a self-diagnostic function at pre-determined time intervals depending on results of a hazard and operability application.

Figure 3:
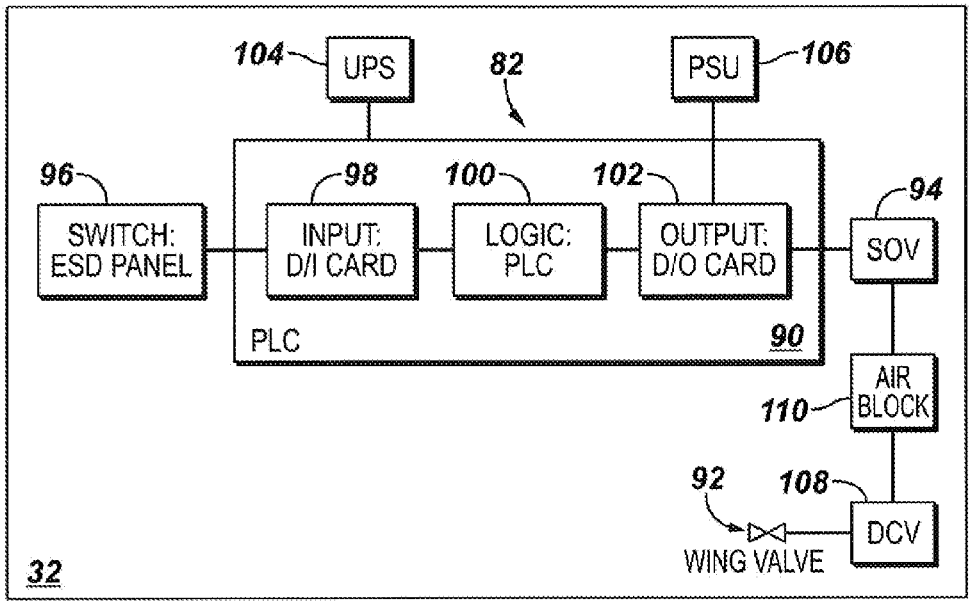
FIG. 3 is a schematic illustration of a portion of the associated control system, according to an embodiment.
Figure 4:
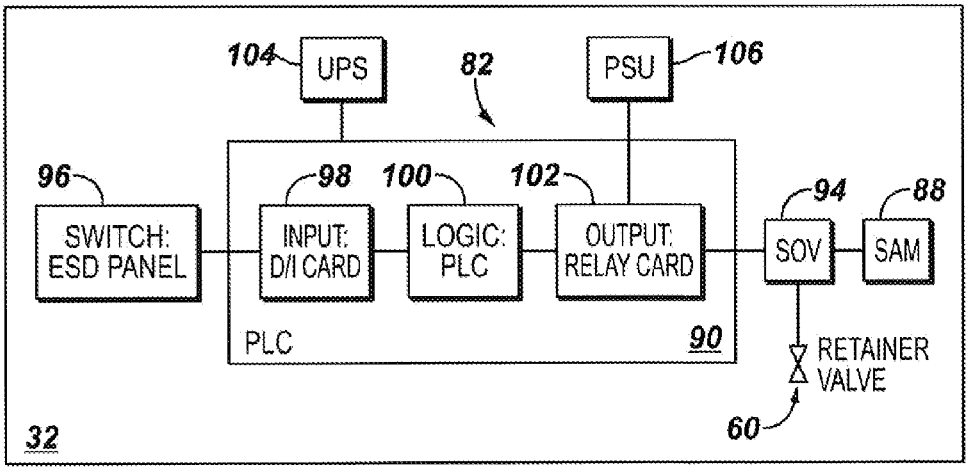
FIG. 4 is a schematic illustration of another portion of the associated control system, according to an embodiment.
Figure 5:
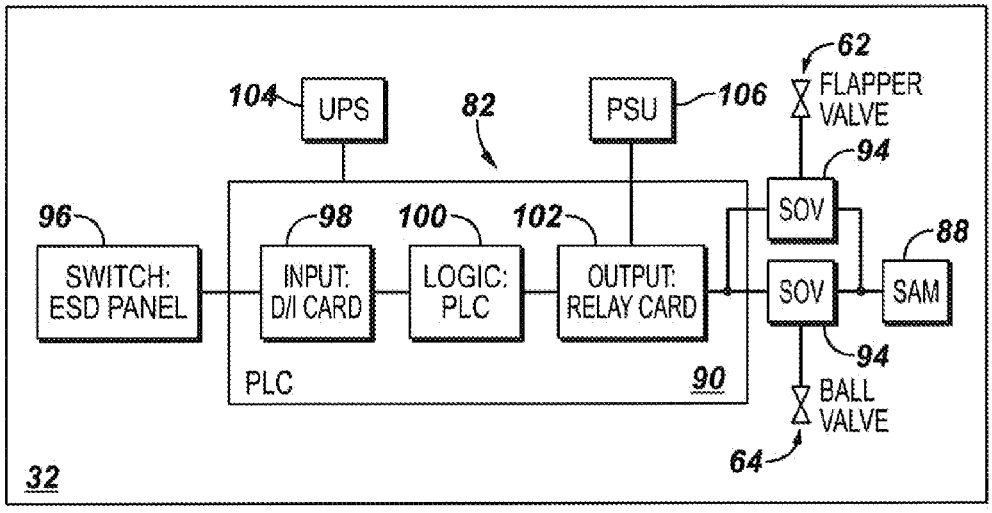
FIG. 5 is a schematic illustration of another portion of the associated control system, according to an embodiment.

Referring generally to FIGS. 3-5, a variety of subsea control system functions/implementations are illustrated via schematic block diagrams. In the embodiment illustrated in FIG. 3, for example, control system 32 utilizes a surface based master control system 82 comprising a programmable logic control system 90 to isolate topside flow output via a production wing valve 92. The wing valve 92 may comprise a master valve, a downhole safety valve, or another wing valve operated by the production control system. By way of example, the overall system may be designed at a SIL3 level while the subsea test tree employed in the subsea installation 22 is at an SIL2 level.

In the embodiment illustrated in FIG. 3, the topside wing valve 92 is operated by a high pressure system through a solenoid actuated valve 94 controlled via programmable logic controller 90 in master control system 82. The valve 94 is considered to be in a safe state when it is in its closed position. To avoid problems if programmable logic controller 90 fails to actuate the valve when desired, the system may be designed to enable manual triggering of the valve. Verification that wing valve 92 has been actuated can be based on select parameters. For example, the verification may be based on detection of actuation current delivered by the master control system; detection of the actuation voltage required to achieve the desired current (implied impedance); and/or operator verification of the position of the wing valve via an appropriate gauge or sensor.

In the specific example illustrated, programmable logic controller 90 is coupled to an emergency shutdown panel 96. Additionally, the programmable logic controller 90 comprises an input module 98, a logic module 100, and an output module 102. The programmable logic controller 90 may be powered by an uninterruptible power supply 104, and the output module 102 may be independently coupled to a power supply unit 106. The output module 102 controls actuation of solenoid valve 94 which, in turn, controls delivery of hydraulic actuation fluid to wing valve 92. Additional components may be positioned between solenoid valve 94 and wing valve 92 to provide an added level of control and safety. Examples of such components comprise a supplemental valve 108 and an air block 110.

A similar control technique may be used to control actuation of retainer valve 60 in upper portion 54, as illustrated in FIG. 4. In this example, the emergency shutdown sub-function begins at the master control system 82 where the demand is initiated, however the function does not include other initiating factors. The function concludes with the retainer valve 60 closing with respect to riser 52. An appropriate SIL level for this sub-function may be SIL2. Verification that retainer valve 60 has been actuated to a closed position can be based on select parameters. For example, the verification may be based on detection of actuation current delivered by the master control system; detection of the actuation voltage required to achieve the desired current (implied impedance); detection of flow as measured by flow meters on the hydraulic power unit 86; and/or measuring a pressure response with transducers on the subsea accumulator module 88.

Another control technique/sub-function is used to isolate subsea well 30 via the shut-off valves, e.g. valves 62, 64, in the lower portion 56 of subsea test tree 26, as illustrated in FIG. 5. In this specific example, two shut-off valves are utilized for the sake of redundancy in the form of flapper valve 62 and ball valve 64, however one valve is sufficient to leave the subsea well 30 in a safe state. In this example, the emergency shutdown sub-function begins at the master control system 82 where the demand is initiated, however the function does not include other initiating factors. The function concludes with the flapper valve 62 and/or ball valve 64 closing with respect to subsea well 30. An appropriate SIL level for this sub-function may be SIL2. Verification that at least one of the flapper valve 62 and ball valve 64 has been actuated to a closed position can be based on select parameters. For example, the verification may be based on detection of actuation current delivered by the master control system; detection of the actuation voltage required to achieve the desired current (implied impedance); detection of flow as measured by flow meters on the hydraulic power unit 86; and/or measuring a pressure response with transducers on the subsea accumulator module 88.

The safety integrity levels (SILs) described herein are not necessarily derived from a risk-based approach for determining SIL levels as described in standard IEC61508. Instead, the SIL levels sometimes are based on industry recognized standards for production system safety functions. Based on the minimum SIL requirements for each function as applies to the existing layers of protection, the minimum SIL level for the various safety integrity functions, e.g. the sub-functions outlined in FIGS. 3-5, may be selected as SIL2.

Additionally, the subsea test tree 26 and its corresponding shut-off valves 60, 62, 64 may be operated completely independently with respect to operation of the production control system 24 which is used during normal operations. In this case, the overall control system 32 may comprise completely independent control systems for the subsea test tree 26 and the production control system 24. The subsea test tree 26 may be installed within the production control system 24, e.g. inside a Christmas tree, during operation inside the blowout preventer stack 40. In the event that the blowout preventer 40 is required to close, the subsea test tree 26 is sealed and disconnected from the string (separated at connector 58). This allows the upper portion 54 of the subsea test tree 26 to be retracted so the blowout preventer rams can be closed without interference.

If the upper portion 54 cannot be unlatched and retracted during a subsea test tree failure mode, the shear rams 48 may be operated to sever the tool and safely close the well. The blowout preventer control system has no influence on the safety functions of the subsea test tree system. One example of a closing pattern comprises closing the upper retainer valve 60, followed by closure of the lower ball valve 64 and subsequent closure of the flapper valve 62. Once the upper production string is sealed via retainer valve 60 and access to the wellbore is sealed via ball valve 64 and flapper valve 62, the subsea test tree is disconnected and separated at connector 58.

Figure 6:
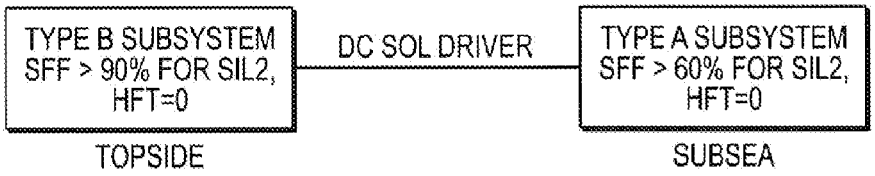
FIG. 6 is a schematic illustration of safety relevant parameters topside and subsea, according to an embodiment.

Specific safety relevant parameters may be selected according to the system design, environment, and applicable requirements in a given geographical location. However, one example of a typical approach is illustrated in FIG. 6 as having a safe failure fraction exceeding 90% on the topside for a Type B safety system (complex) and a hardware fault tolerance of zero, per standard IEC61508-2. At the subsea location, the system comprises a Type A subsystem having a safe failure fraction greater than 60% and a hardware fault tolerance of zero. Final elements on the topside may be evaluated to the DC fault model per IEC61508-2 (fault stuck at Vcc and stuck at Gnd, as well as stuck open and stuck shorted). Final elements in the subsea portion of the system are evaluated as a Type A system because only discrete passive components are used. All failure modes of these components are well defined and sufficient field data exists to be able to assume all fault conditions.

The accumulator module 88 may be incorporated into the overall system in a variety of configurations and at a variety of locations. In one example, accumulator module 88 is a pressure balanced accumulator to provide hydraulic power to the system in case of emergency closure and disconnect and/or loss of hydraulic power from the surface.

Accumulators are devices that provide a reserve of hydraulic fluid under pressure and are used in conventional hydraulically-driven systems where hydraulic fluid under pressure operates a piece of equipment or a device. The hydraulic fluid is pressurized by a pump that maintains the high pressure required.

If the piece of equipment or the device is located a considerable distance from the pump, a significant pressure drop can occur in the hydraulic conduit or pipe which is conveying the fluid from the pump to operate the device. Therefore, the flow may be such that the pressure level at the device is below the pressure required to operate the device. Consequently, operation may be delayed until such a time as the pressure can build up with the fluid being pumped through the hydraulic line. This result occurs, for example, with deep water applications, such as with subsea test tree and blowout preventer equipment used to shut off a wellbore to secure an oil or gas well from accidental discharges to the environment. Thus, accumulators may be used to provide a reserve source of pressurized hydraulic fluid for this type of equipment. In addition, if the pump is not operating, accumulators can be used to provide a reserve source of pressurized hydraulic fluid to enable the operation of a piece of equipment or device.

Accumulators may include a compressible fluid, e.g., gas, nitrogen, helium, air, etc., on one side of a separating mechanism, and a non-compressible fluid (hydraulic fluid) on the other side. When the hydraulic system pressure drops below the precharged pressure of the gas side, the separating mechanism will move in the direction of the hydraulic side displacing stored hydraulic fluid into the piece of equipment or the device as required.

When some types of accumulators are exposed to certain hydrostatic pressure, such as the hydrostatic pressure encountered in subsea operations, the available hydraulic fluid is decreased since the hydrostatic pressure must first be overcome in order to displace the hydraulic fluid from the accumulator. However, pressure balanced accumulators may be employed to overcome the above-described shortcomings. Examples of pressure-balanced accumulators are disclosed in U.S. Pat. No. 6,202,753 to Benton and U.S. Patent Publication No. 2005/0155658-A1 to White.

Figure 7:
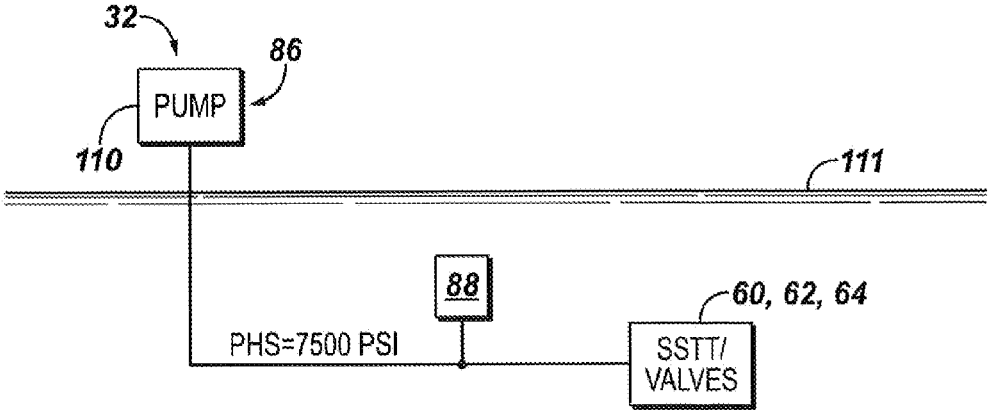
FIG. 7 is a schematic illustration of one example of the subsea control system incorporating a pressure balanced accumulator, according to an embodiment.

Referring generally to FIG. 7, an example of one implementation of accumulator module 88 is illustrated. In this example, accumulator module 88 is a pressure balanced accumulator system. The accumulator system 88 is connected with the one or more hydraulic lines 74 routed between hydraulic power unit 86 and subsea test tree 26. Hydraulic power unit 86 may comprise one or more suitable pumps 110 for pumping hydraulic fluid. The hydraulic power unit 86 is located above a sea surface 111 and provides control fluid for the operation of, for example, blowout preventer 40 and the valves 60, 62, 64 of subsea test tree 26. The pressurized hydraulic fluid from hydraulic power unit 86 also is used to charge the pressure balanced accumulator system 88. By way of example, the hydrostatic pressure $P_{HS}$ supplied by pump 110 is approximately 7500 psi, although other pressure levels may be used.

Figure 8:
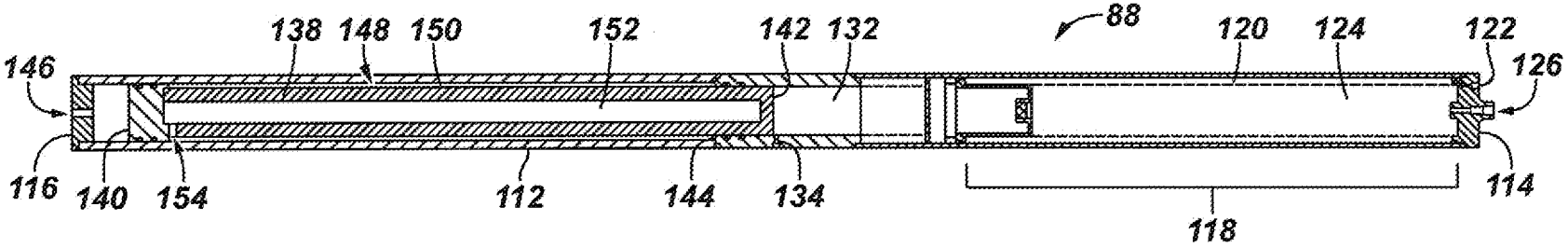
FIG. 8 is a cross-sectional view of one example of the pressure balanced accumulator illustrated in FIG. 7, according to an embodiment.
Figure 9:
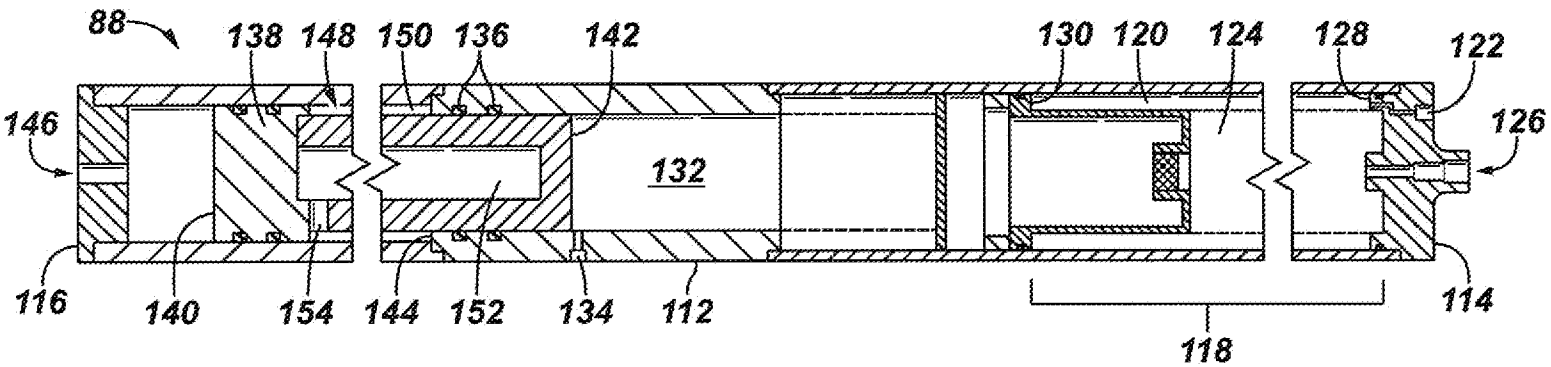
FIG. 9 is a cross-sectional view of an enlarged portion of the pressure balanced accumulator illustrated in FIG. 8, according to an embodiment.

Referring generally to FIGS. 8 and 9, one embodiment of a pressure balanced accumulator 88 is illustrated. The illustrated embodiment is readily utilized in conjunction with subsea test tree 26, production control system 24, and control system 32. As illustrated, the pressure balanced accumulator 88 comprises a housing 112, which is a generally tubular-shaped member having two ends 114 and 116. An accumulator mechanism 118 is located within the housing 112 proximate the first end 114. The accumulator mechanism 118 comprises a first chamber 120 (see FIG. 9) for receiving a pressurized gas at a first pressure. The pressurized gas may, for example, be injected into chamber 120 through gas precharge port 122. In one embodiment of the present invention, the gas in the first chamber 120 is helium, and it is pressurized to approximately 3500 psi, although other pressures may be used depending on the specific application.

With further reference to FIGS. 8 and 9, accumulator mechanism 118 also comprises a second chamber 124 for receiving a first pressurized fluid at a second pressure. The pressure of the fluid in chamber 124 is sometimes referred to as the "gauge pressure." In one embodiment, liquid may be injected into chamber 124 via a seal stab port 126. The liquid injected into chamber 124 may be in the form of a water glycol mixture according to one embodiment of the present invention. By way of example, the mixture may be injected into chamber 124 at a pressure of approximately 5000 psi, although other pressures may be utilized in other applications. Chambers 120 and 124 are hermetically sealed from one another at regions 128 and 130.

The pressure balanced accumulator system 88 may further comprise a third chamber 132 which abuts accumulator mechanism 118 in housing 112. Third chamber 132 contains a fluid, which may be injected into chamber 132 via fluid fill port 134. In one embodiment, the fluid injected into third chamber 132 is silicon oil, which is selected for use because of its lubricity and because it will not adversely affect seals 136 deployed to seal along one end of chamber 132. Initially, the silicon fluid is not injected into third chamber 132 under pressure. In operation, however, the pressure of the fluid in chamber 132 tracks the pressure of the fluid in second chamber 124, as described below.

Pressure balanced accumulator 88 also comprises a piston 138 which is located within the housing proximate the second end 116 of housing 112. The piston 138 has a first end 140 and a second end 142 which have first and second cross-sectional areas, respectively. In one embodiment, the cross-sectional areas of piston ends 140 and 142 are circular in shape. Piston 138 is movable between a first position, as shown in FIG. 8, and a second position in which piston end 140 is stopped by a shoulder 144.

Housing end 116 also may comprise an ambient pressure port 146. When pressure balanced accumulator 88 is used in a subsea environment, ambient pressure port 146 permits the ambient subsea pressure to impinge on end 140 of piston 138.

In the illustrated embodiment, pressure balanced accumulator system 88 also comprises an atmospheric chamber 148 which includes an annular recess 150 formed between piston 138 and the wall of housing 112; an axial cavity 152 which is formed by hollowing out a portion of piston 138; and a passage 154 connecting annular recess 150 and axial cavity 152. This atmospheric chamber allows differential pressure to exist across piston 138 which enables the piston to start to move when an equilibrium pressure exists across piston 138 as discussed below. In one embodiment, the pressure in the atmospheric chamber is 14.7 psi, the volume of annular recess 150 is approximately 10 in.sup.3, and the volume of axial cavity 152 is approximately 200 in.sup.3.

In subsea applications, such as the subsea applications described above, accumulator module 88 may be located in a subsea environment to control the operation of an in-riser or open water intervention system, such as subsea test tree 26 and associated valves 60, 62, 64. The first and second chambers 120 and 124 in accumulator mechanism 118 of pressure balanced accumulator system 88 are precharged prior to placement of pressure balanced accumulator system 88 in the subsea environment. Pump 110, which is located above the sea surface 111, provides the control fluid for the operation of blowout preventer 40 and shut-off valves 60, 62, 64. The pump 110 also provides a charging input to second chamber 124 of accumulator mechanism 118 in pressure balanced accumulator system 88.

For purposes of illustration, it can be assumed that the hydrostatic pressure, $P_{HS}$, in which pressure balanced accumulator 88 is operating is 7500 psi, although other pressures may be employed. This ambient pressure is communicated through ambient pressure port 146 of accumulator system 88 and impinges on end 140 of piston 138. The force acting on piston 138 at its end 140 is given by the formula:

$$F_1 = P_{HS} \times (\text{the area of piston end 140}). \quad (1)$$

The force on end 142 of piston 138 is given by the formula:

$$F_2 = (P_{HS} + 5000) \times (\text{the area of piston end 142}). \quad (2)$$

In one specific example of the present invention, piston ends 140 and 142 are circular in cross-section and have cross-sectional areas established by diameters of 3.375 inches and 2.688 inches, respectively, although the sizes are for purposes of explanation only. At the hydrostatic pressure of 7500 psi, the equilibrium pressure, $P_E$, at which the piston 138 starts to move is:

$$P_E = 7500 \cdot \left(\frac{3.375}{2.688}\right) \cdot 2 = 11{,}824 \text{ lb}f \quad (3)$$

The gauge pressure $P_G$ at which the piston begins to move is given by the formula:

$$P_G = P_E - P_{HS} = 11{,}824 - 7{,}500 P_G = 4{,}324 \text{ psi} \quad (4)$$

In accordance with the present invention, the diameter of piston ends 140 ($D_1$) and 142 ($D_2$) may be sized for optimal efficiency at a predetermined hydrostatic pressure, using the following formula:

$$D_1 = \sqrt{\frac{(P_{HS} + P_C - S)}{P_{HS}}} \cdot D_2$$

where $P_C$ is the pressure to which the second chamber of accumulator mechanism 118 is charged, e.g., 5000 psi, and S is a hydraulic safety factor which is an allowance given to prevent instability in maximum hydrostatic conditions. For a hydrostatic pressure of 7500 psi, S is approximately 500 psi. If $D_2$=2.688 inches as in the above calculation with respect to equations (3) and (4) then $D_4$ according to equation (5) is 3.40 inches.

Figure 10:
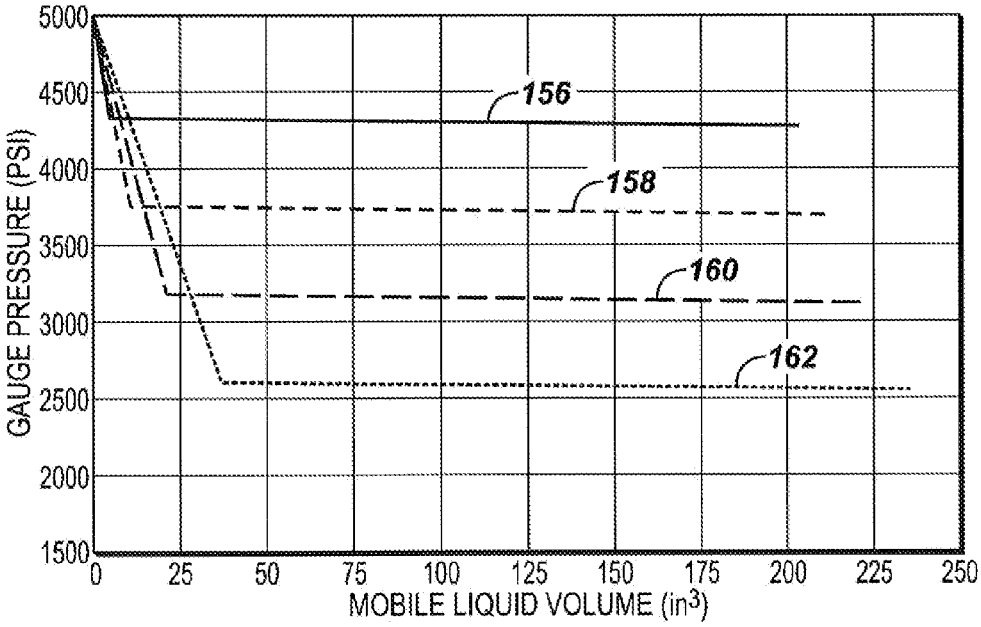
FIG. 10 is a graph illustrating fluid volume expelled from the pressure balanced accumulator at different hydrostatic pressure levels, according to an embodiment.

In FIG. 10, a graph is presented with a graph line 156 provided to illustrate the fluid volume of fluid expelled from the accumulator mechanism 118 at a hydrostatic pressure of 7500 psi and with $D_1$ and $D_2$ being 3.375 inches and 2.688 inches, respectively. Graph lines 158, 160 and 162 illustrate fluid volume expelled at hydrostatic pressures of 6500, 5500 and 4500 psi, respectively.

The overall subsea control system 20 may be designed for use in a variety of well applications and well environments. Accordingly, the number, type and configuration of components and systems within the overall system may be adjusted to accommodate different applications. For example, the subsea test tree may include different numbers and types of shut-off valves as well as a variety of connectors, e.g. latch mechanisms, for releasably connecting the upper and lower parts of the subsea test tree. The production control system also may comprise various types and configurations of subsea installation components. Similarly, the control system 32 may rely on various topside and subsea components which enable independent control over the subsea test tree and the blowout preventer. In some applications, the control system utilizes surface components which are computer-based to enable easy input of commands and monitoring of subsea functions. As described above, programmable logic controllers also may be employed and used to carry out various sub-functions implemented in emergency shutdown procedures. Various adaptations may be made to accommodate specific environments, types of well equipment, applicable standards, and other parameters which affect a given subsea well application.

Figure 11:
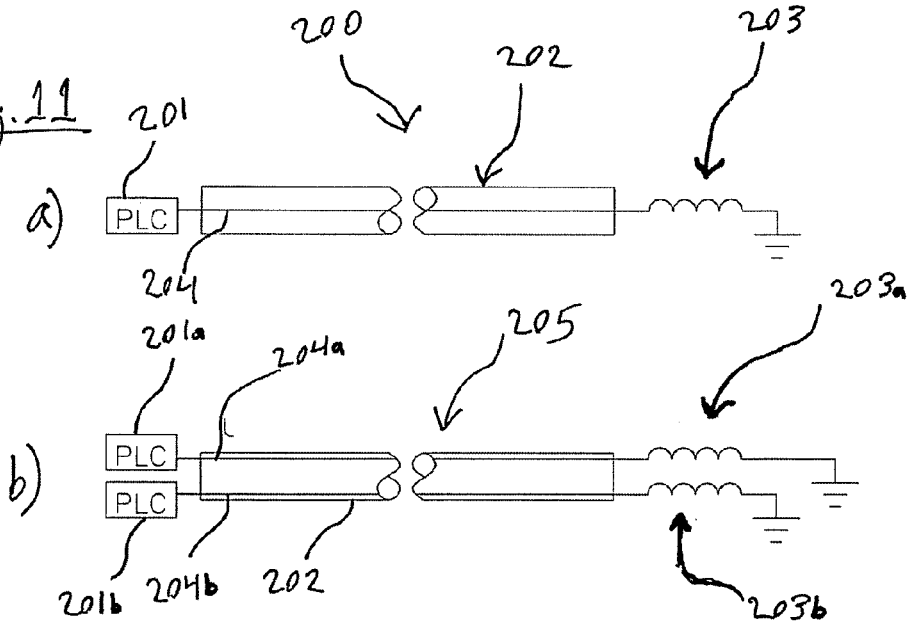
FIG. 11 is a schematic of a dual path control system according to an embodiment.

According to embodiments, the subsea control systems described herein can include a dual path system. FIG. 11*a* shows a single path control system 200. A programmable logic controller (PLC) 201 is connected with a single control path 204 through the umbilical 202. The single control path 204 connects with a valve coil 203 that controls actuation of a valve. The control path can be an electrical conductor. FIG. 11*b* shows an embodiment of a dual path system 205. The dual path system 205 has a primary PLC 201*a* and a slave PLC 201*b*. Primary PLC 201*a* is connected with control path 204*a* and slave PLC 201*b* is connected with secondary control path 204*b*. The control paths 204*a* and 204*b* extend through the umbilical 202. The first control path 204*a* connects with a primary valve coil 203*a*. The secondary control path 204*b* connects with a secondary valve coil 203*b*. The slave PLC 201*a* will duplicate the commands sent by the master PLC 201*a*, but on the secondary control path 204*b*. This keeps operations transparent to the field technician. Once split onto the two control paths, the commands are transmitted by the master PLC 201*a* and slave PLC 201*b* down the primary control path 204*a* and secondary control path 204*b*, respectively. At the subsea end, dual coils can be incorporated on all of the solenoid valves on the subsea control module (SCM). The valves are capable of being actuated by either coil. The primary valve coil 203*a* for each valve will be coupled to the primary control path 204*a* and the secondary valve coil 203*b* will be coupled to the secondary control path 204*b*. Thus, if there is a failure on the primary control path 204*a* which will not allow the primary coil 203*a* to be energized, the solenoid valve will still operate when commanded by means of the secondary control path 204*b* and secondary coil 203*b*. When no fault exists, both coils will fire and the valve will operate. The splitting of the control commands onto the two control paths can be accomplished in the SCM, wherein a programmable logic controller (PLC) is slaved to the primary, master programmable logic controller. The programming of the master PLC 201*a* and slave PLC 201*b* is such that the slave PLC 201*b* will interpret what command the master intends to or sends and will send the same command (i.e. duplicate) on the secondary control path 204*b*. The slave PLC 201*b* can report voltage and current values back to the master PLC 201*a* for logging and display on the HMI via a communications link. The slave PLC 201*b* will send the intended command even if this link is lost. This configuration increases the likelihood of functions occurring when they are commanded, i.e. in the event of any component failure.

In order that the output control signals should reach the appropriate valve, signals can be demultiplexed at the SCM via a subsea electronics module (SEM). A feature of various embodiments of the SenTURIAN SEM is that they may contain no active electronics. According to various embodiments, only passive components such as diodes are contained in the SEM. In the dual path SCM, there can be two SEM's.

The addition of a second electrical control path to an existing control system would otherwise demand a second umbilical to be deployed in parallel with the first, however, in the dual path system, primary and secondary control signals are conveyed via electric well logging cables encapsulated within the same control umbilical. The use of well logging cables as elements within the umbilical allows many more conductors to be incorporated into the umbilical assembly than space would otherwise permit. The use of a single umbilical to provide two separate control paths is preferable to having two independent umbilicals, as redundancy of the following equipment can be eliminated, e.g., winch/reeler, tension control system, riser clamps, sheave wheels, jumper cables. Elimination of the need for redundancy of this equipment can save space on a rig and help limit the cost of the control system.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A subsea wellhead control system, comprising:

a subsea test tree having an upper part and a lower part connecting at a disconnect point;

the upper part comprising a retainer valve;

the lower part comprising a ball valve and a flapper valve;

a control system for controlling actuation of the subsea test tree including the retainer valve, the ball valve and the flapper valve; and the control system comprising a primary valve coil that is connected to and actuated by a primary control path and a secondary valve coil that is connected to and actuated by a secondary control path, the primary and secondary control path both extending through a first umbilical;

the primary control path connecting with a master programmable logic controller and the secondary control path connecting with a slave programmable logic controller.

2. The subsea wellhead control system as recited in claim 1, further comprising a pressure balanced accumulator associated with the control system and in hydraulic communication with the subsea test tree;

wherein the pressure balanced accumulator comprises a housing having a generally tubular-shaped member having first and second ends.

3. The subsea wellhead control system as recited in claim 2, wherein the pressure balanced accumulator further comprises an accumulator mechanism located within the housing proximate the first end of the housing wherein the accumulator mechanism comprises a first chamber for receiving a pressurized gas at a first pressure and a second chamber for receiving a first pressurized fluid at a second pressure and where the first and second chambers are hermetically sealed from one another.

4. The subsea wellhead control system as recited in claim 3, wherein the pressure balanced accumulator further comprises a third chamber in the housing which abuts one end of the accumulator mechanism, where the third chamber contains an oil fluid.

5. The subsea wellhead control system as recited in claim 4, wherein the pressure balanced accumulator further comprises a movable piston which is located within the housing proximate the second end of the housing, the movable piston having first and second ends with first and second cross-sectional areas, respectively, where the piston is movable between a first position and a second position, wherein the second end of the housing includes a port to permit ambient subsea pressure to impinge on the first end of the piston, where the second end of the piston contacts the third chamber, and where the cross-sectional areas of the first and second ends of the piston are selected so as to optimize the pressure in the second chamber at which the piston begins to expel fluid from the second chamber of the accumulator.

6. The subsea wellhead control system as recited in claim 1, wherein the control system comprises surface components and subsea components.

7. The subsea wellhead control system as recited in claim 1, further comprising a blowout preventer stack independently controlled with respect to the subsea test tree.

8. The subsea wellhead control system as recited in claim 1, wherein the primary control path and the secondary control path each comprise electrical conductors.

9. The subsea wellhead control system as recited in claim 8, further comprising at least one shear ram.

10. The subsea wellhead control system as recited in claim 1, wherein the upper part and the lower part operate within a riser.

11. The subsea wellhead control system as recited in claim 6, wherein the slave programmable logic controller interprets a command of the master programmable logic controller and sends a duplicate command on the secondary control path to the secondary valve coil.

12. A subsea control system, comprising:

a subsea test tree;

a control system for actuating at least one part of the subsea test tree, comprising a primary valve coil that is connected to and actuated by a primary control path and a secondary valve coil that is connected to and actuated by a secondary control path, the primary and secondary control paths both extending through a first umbilical that extends from surface to the control system;

the primary control path connects with a master programmable logic controller and the secondary control path connects with a slave programmable logic controller.

13. The subsea control system as recited in claim 12, wherein the subsea test tree comprises:

a retainer valve located in an upper portion;

at least one valve located in a lower portion;

a latch mechanism releasably coupling the upper portion to the lower portion.

14. The subsea control system as recited in claim 13, wherein the primary valve coil and the secondary valve coil actuate at least one of the following: the retainer valve and the at least one valve located in the lower portion.

15. The subsea control system as recited in claim 14, wherein the slave programmable logic controller interprets a command of the master programmable logic controller and duplicates the same command on the secondary control path to the secondary valve coil.

16. The subsea control system as recited in claim 12, further comprising a pressure balanced accumulator connected in cooperation with the control system.

17. The subsea control system as recited in claim 16, wherein the pressure balanced accumulator is operable to control the retainer valve, located in the upper portion, and the at least one valve located in the lower portion.

18. The subsea control system as recited in claim 17, wherein the primary control path and the secondary control path each comprise an electrical conductor.

19. A method for controlling a subsea wellhead, comprising:

forming a subsea test tree;

positioning the subsea test tree in a subsea installation;

coupling the subsea test tree with a control system to control and actuate at least one portion of the subsea test tree;

an umbilical connecting to the control system; and actuating the at least one portion of the subsea test tree by sending a signal from a master programmable logic controller on a primary control path, interpreting the signal from the master programmable logic controller with a slave programmable logic controller, and sending a duplicate command with the slave programmable logic controller on a secondary control path to a secondary valve coil, wherein the primary and secondary control paths both extend through the umbilical.

20. The method as recited in claim 19, wherein the umbilical extends from surface to the control system.

* * * * *